US009945114B2

(12) United States Patent
Jaccard et al.

(10) Patent No.: US 9,945,114 B2
(45) Date of Patent: Apr. 17, 2018

(54) SYSTEM AND METHOD FOR THE RAPID INSTALLATION OF A PORTABLE BUILDING IN A CONFINED VERTICALLY INACCESSIBLE LOCATION

(71) Applicant: The United States of America as represented by the Secretary of the Navy, Washington, DC (US)

(72) Inventors: Gregory A. Jaccard, San Diego, CA (US); Robert D. Carmichael, Murrieta, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 15/195,138

(22) Filed: Jun. 28, 2016

(65) Prior Publication Data

US 2017/0370092 A1 Dec. 28, 2017

(51) Int. Cl.

| | |
|---|---|
| ***B66C 1/00*** | (2006.01) |
| ***E04B 1/35*** | (2006.01) |
| ***E04B 1/348*** | (2006.01) |
| ***E04B 1/343*** | (2006.01) |

(52) U.S. Cl.

CPC ..... *E04B 1/35* (2013.01); *E04B 1/34336* (2013.01); *E04B 1/34815* (2013.01); *E04B 2001/3577* (2013.01)

(58) Field of Classification Search

CPC ..... B66C 1/105; E04B 1/35

USPC ... 294/67.2, 67.21, 67.22, 82.22, 67.5, 81.3; 182/2.6, 113, 115, 16, 145, 223; 414/373, 543

See application file for complete search history.

(56) References Cited

U.S. PATENT DOCUMENTS 1,804,266 A * 5/1931 Moore ..... B66C 1/105 294/67.2
2,598,730 A * 6/1952 Thompson ..... B63C 5/02 182/113
2,669,490 A * 2/1954 Kaufman ..... E01D 19/106 182/145
2,816,792 A * 12/1957 Dixon ..... B66C 1/24 294/103.2
3,275,367 A * 9/1966 Bopp ..... B66C 1/24 294/67.21
3,438,160 A * 4/1969 Gostling ..... B66C 1/105 249/13
3,450,280 A * 6/1969 Colnot ..... B66C 1/105 249/19
3,600,030 A * 8/1971 Varon ..... B66C 1/16 294/67.4
3,675,961 A * 7/1972 Wheeler ..... B66C 1/105 294/67.1

(Continued)

*Primary Examiner* — Paul T Chin

(74) *Attorney, Agent, or Firm* — SPAWAR Systems Center Pacific; Kyle Eppele; Susanna J. Torke

(57) ABSTRACT

A device comprising a weldment having an upper beam, a vertical beam, and a lower beam, wherein the upper beam further comprises at least two lifting eyes and at least one crane hook, and the lower beam further comprises a plurality of swivel-hoist rings and a plurality of forklift pockets, and wherein the lower beam is a length minimally required to locate a structure laterally underneath an upper level of a platform having an upper level and a lower level.

14 Claims, 7 Drawing Sheets

(56) References Cited

U.S. PATENT DOCUMENTS

| | | | | | |
|---|---|---|---|---|---|
| 3,897,097 | A * | 7/1975 | Davis, Jr. | B66C 1/24 | 294/67.1 |
| 4,160,509 | A * | 7/1979 | Switzer | B66F 9/18 | 105/378 |
| 4,671,721 | A * | 6/1987 | Pratt | B66C 1/105 | 294/67.1 |
| 4,955,972 | A * | 9/1990 | LaBounty | B66C 3/00 | 294/67.2 |
| 5,775,753 | A * | 7/1998 | Tetelboim | B66C 1/24 | 294/67.21 |
| 6,039,500 | A * | 3/2000 | Kwon | B66C 1/66 | 294/215 |
| 6,126,023 | A * | 10/2000 | Durrant-Whyte | B66C 13/06 | 212/274 |
| 6,202,863 | B1 * | 3/2001 | Grenier | B65D 88/123 | 211/70.4 |
| 2003/0051915 | A1 * | 3/2003 | Brittain | E21B 15/00 | 175/52 |
| 2004/0056493 | A1 * | 3/2004 | Vanagan | B66C 1/105 | 294/67.21 |
| 2011/0037279 | A1 * | 2/2011 | Alba | B66C 1/108 | 294/215 |
| 2011/0109106 | A1 * | 5/2011 | Inda | B66C 1/108 | 294/215 |

* cited by examiner

SYSTEM AND METHOD FOR THE RAPID INSTALLATION OF A PORTABLE BUILDING IN A CONFINED VERTICALLY INACCESSIBLE LOCATION

FEDERALLY-SPONSORED RESEARCH AND DEVELOPMENT

A System and Method for the Rapid Installation of a Portable Structure in a Confined Vertically Inaccessible Location is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil. Reference Navy Case Number 103010.

BACKGROUND

A need exists for a system and method to install a portable building or container (structure) in a vertically inaccessible location with limited access to one lateral side of the installation site.

DETAILED DESCRIPTION OF SOME EMBODIMENTS

Figure 1:
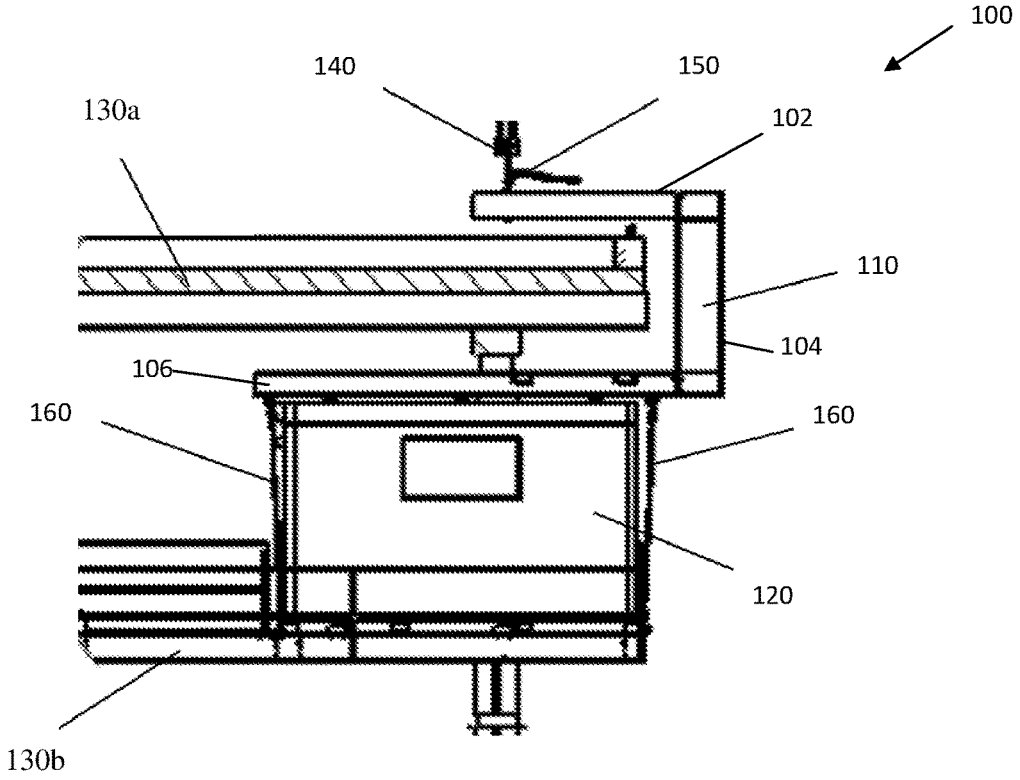
FIG. 1 shows a front view of a lifting apparatus/structure assemblage in use.

Reference in the specification to "one embodiment" or to "an embodiment" means that a particular element, feature, structure, or characteristic described in connection with the embodiments is included in at least one embodiment. The appearances of the phrases "in one embodiment," "in some embodiments," and "in other embodiments" in various places in the specification are not necessarily all referring to the same embodiment or the same set of embodiments.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or.

Additionally, use of the "a" or "an" are employed to describe elements and components of the embodiments herein. This is done merely for convenience and to give a general sense of the invention. This detailed description should be read to include one or at least one and the singular also includes the plural unless it is obviously meant otherwise.

The system and method disclosed herein comprises a novel lifting apparatus, a container or building (hereinafter 'structure') to be installed, an installation site with limited or no direct vertical access, supplemental lifting and load-transfer accompaniments, and heavy lifting equipment such as a crane or forklift.

Installation of a structure can be achieved with a lifting apparatus and load transfer method allowing for maximum available dimensions for the structure. The method of deployment and recovery of the structure also requires a load-transfer block, building support lines, load-transfer sling, and traditional lifting equipment including a crane and forklift. The methodology emphasizes a rapid deployment or recovery operation in order to minimize down-time and provide for the prompt removal of the building in inclement weather conditions.

An initial method for locating a structure, such as a coastal personnel structure, was to install the structure in place. The wooden construction structure was disassembled into sections (floor, wall, roof, etc.) and transported to the site. The site location was the lower deck of a coastal pier with a minimal foundation structure to withstand the water waves and tidal conditions of the site. A less-effective method requires personnel to hand-carry the structure sections and utilize cranes, chain hoists and related gear to emplace the larger structure sections with no overhead access above the site location. The structure sections are then required to be screwed and bolted in place. The operation is extremely labor intensive, requiring 24 man hours to complete the installation. Additionally, the method is risky to personnel and equipment due to the nature of the lower-level and over-water pier installation site.

The system and method described herein is not limited to a coastal personnel structure. The method can be used for any installation site meeting the characteristics described herein, as well as any structure meeting the characteristics described herein.

An embodiment described herein utilizes a lifting apparatus that allows for the use of a standard modular building or container (structure) to be placed in a vertically inaccessible location using minimum added personnel and resources. This embodiment requires very little to no preparation or assembly steps for structure installation. In one embodiment described below, the apparatus and method only requires three personnel one hour to install a modular structure. Ultimately, the embodiment described herein allows for a much easier and efficient installation of a structure.

FIG. 1 shows lifting apparatus/structure assemblage 100. Lifting apparatus 110 comprises steel weldments with upper beam 102, vertical beam 104, and lower beam 106. Upper beam 102 includes two lifting eyes, nuts, or bails of a suitable size not visible in this figure for lifting up lifting apparatus 110 or lifting apparatus/structure assemblage 100. These lifting points coincide with the center-of-mass of lifting apparatus 110 and lifting apparatus/structure assemblage 100 shown. Vertical beam 104 spans upper beam 102 and lower beam 106 and provides the offset necessary to span upper overhanging level above the installation site, which includes upper platform 130*a* and lower platform 130*b*. Lower beam 106 provides attachment points for lifting structure 120 and for hoisting lifting apparatus 110 with a forklift not visible in this figure. Attachment points (not visible here) on lifting apparatus 110 are preferentially swivel-hoist rings to allow for angular lifting and sway compliance of lifting structure 120 when lifted by the lifting apparatus 110. Additionally, lower beam 106 is the length minimally required to locate lifting structure 120 laterally underneath the upper level at installation site 130*a*. Beams 102, 104, and 106 of lifting apparatus 110 are constructed using traditional beam sections or similar sections which provide a large stiffness to weight and strength necessary to hoist assemblage 100 without excessive under-load deflections and with minimum beam height. This minimum beam height for lower beam 106 provides maximal usage of the available vertical space between upper platform 130*a* and lower platform 130*b*.

Structure 120 in one embodiment consists of a conventionally designed modular building with a structural steel base foundation supporting a fiberglass wall and roof structure. This base is designed with pockets and padeye features to be lifted and transported for forklift transport or crane lifting with slings. Alternatively, a structure may have specific features allowing it to be lifted by its upper roof structure. The base lift concept advantage is that a single-beam lower lifting apparatus can hoist a structure with a minimum sling angle which reduces tension loads on the structure sling lines 160.

Figure 2:
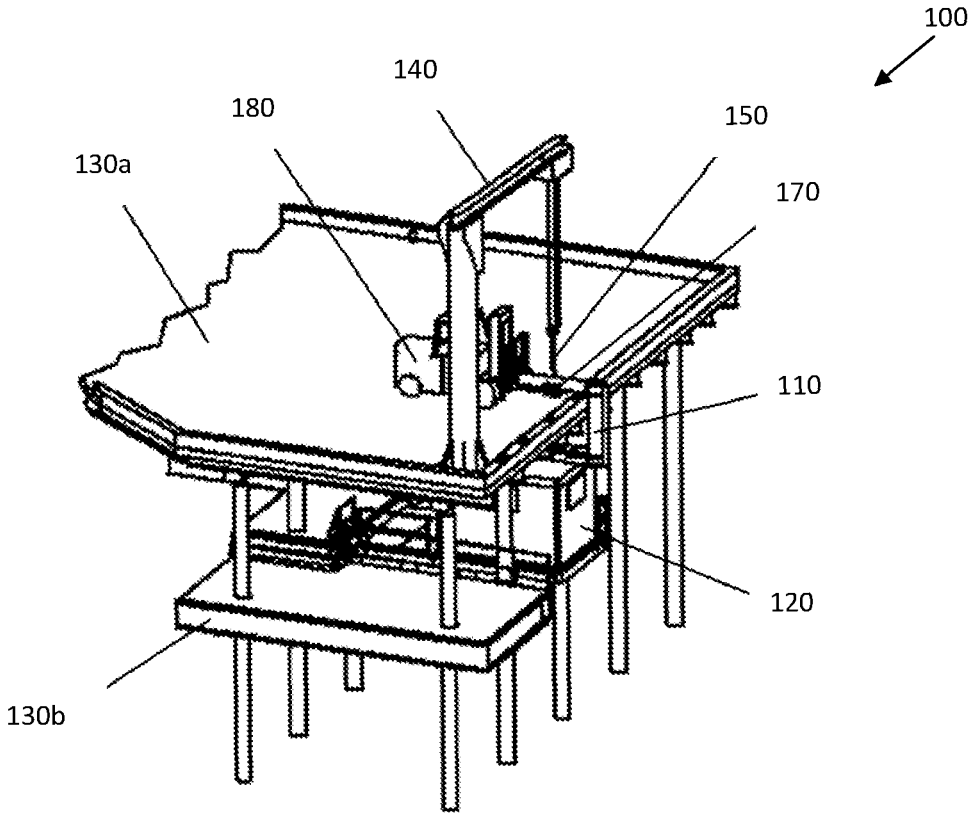
FIG. 2 shows a 3D side view of a lifting apparatus/structure assemblage being installed with a crane, hook, and forklift.

As shown in FIG. 2, a trolley or davit crane and hook 140 provides lifting, lowering, and translation in an area within or adjacent to the vertically inaccessible installation site. The maximum crane hook height will be able to vertically encompass the Lifting Apparatus/structure assemblage 110 and lift over any obstacles in the lateral operation path.

Figure 4A:
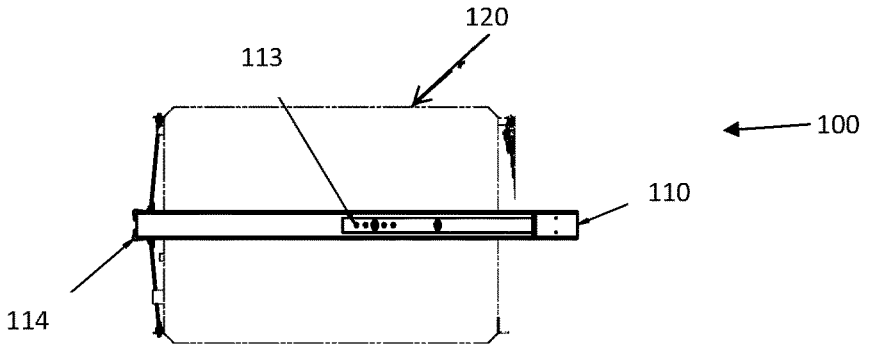
FIG. 4*a* shows a top view of a lifting apparatus.
Figure 4B:
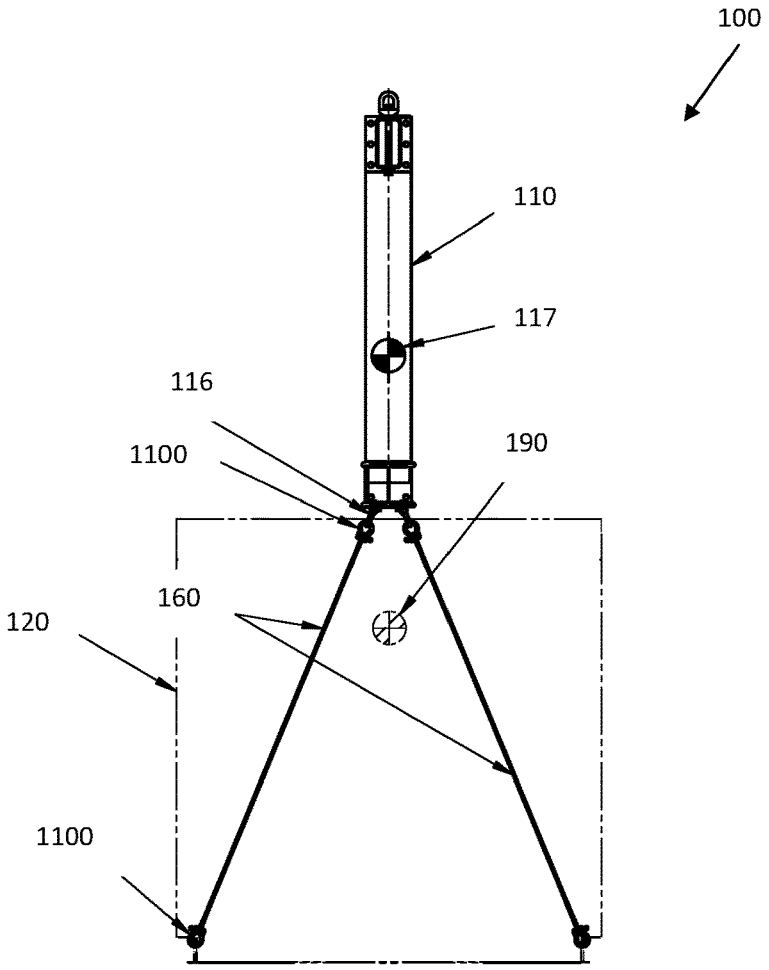
FIG. 4*b* shows a side view of a lifting apparatus.
Figure 4C:
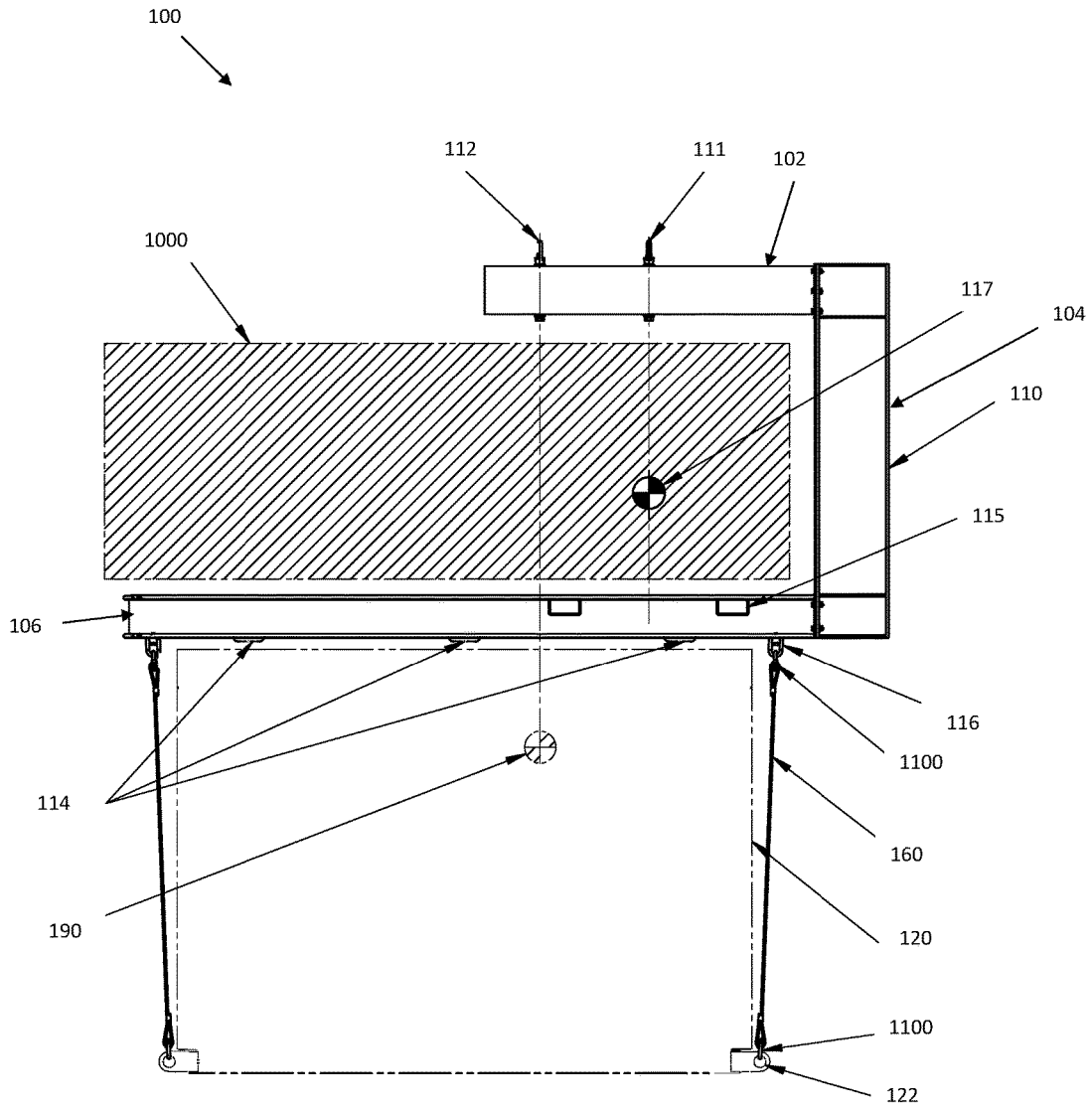
FIG. 4*c* shows a front view of a lifting apparatus.

FIG. 2 shows lifting apparatus 110 having an upper beam 102, a vertical beam 104, and a lower beam 106 (see FIG. 1) operably coupled to structure 120 on an upper level 130*a* of a platform having an upper level 130*a* and a lower level 130*b*, wherein upper beam 102 comprises a crane hook 140, a lifting eye 111 for the weldment only (see FIG. 4*c*), and a lifting eye 112 for the weldment combined with the container (see FIG. 4*c*), and wherein the crane hook 140 and lifting eyes 111 and 112 further comprise a load transfer sling 150 and wherein the lower beam comprises a plurality of swivel-hoist rings 116 (see FIG. 4*c*).

Initially, lifting apparatus 110 is rigged with load transfer sling 150 to lifting eyes 111 and 112 (visible in FIG. 4*c*) and crane hook 140 as shown. Lifting Apparatus 110 is maneuvered above structure 120 using forklift 180 while the upper lifting arrangement loosely follows the position of lifting eyes 111 and 112 (FIG. 4*c*). In this way, Lifting Apparatus 110 is supported from tipping for the overhead lift operation with Forklift 180. Sling lines 160 (visible in FIG. 1) are attached from the bottom of lifting apparatus 110 to the base of structure 120. Sling lines 160 (seen in FIG. 1) are then secured to the base of structure 120. This process is simplified by configuring the motion of travel of lifting apparatus 110 to be co-linear with crane hook 140.

Lifting apparatus/structure assemblage 100 is then hoisted off of upper level 130*a*, laterally positioned outboard, and lowered to just above lower level 130*b*. Lifting Apparatus/structure assemblage 100 is then translated laterally to the installation site and placed onto lower level 130*b*.

Figure 3:
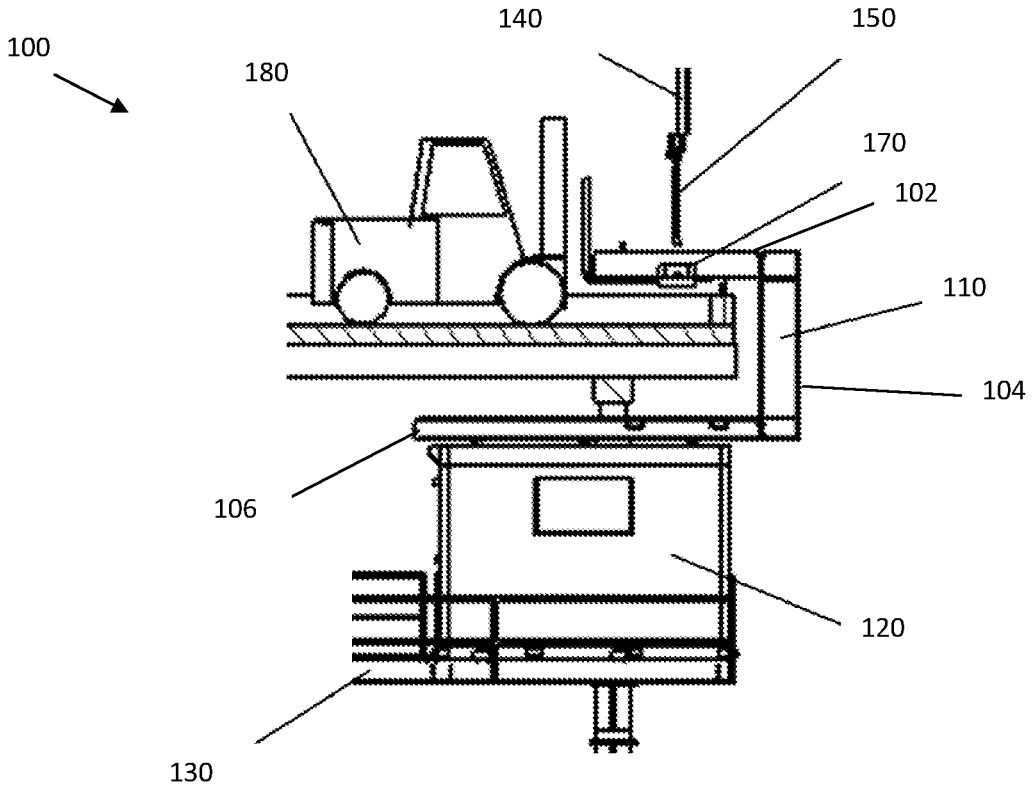
FIG. 3 shows a side view of a lifting apparatus/structure assemblage being installed.

At this stage, as shown in FIG. 3, lifting apparatus 110 is lowered slightly to unload the sling lines 160 (seen in FIG. 1) and concurrently supported on upper beam 102 by load-transfer block 170. With load-transfer block 170 supporting lifting apparatus 110, load transfer sling 150 is detached from the lifting eye 112 for the weldment combined with the container (see FIG. 4*c*) and positioned taut over the lifting eye 111 for the weldment only (see FIG. 4*c*). Load-transfer block 170 is then removed, and sling lines 160 are detached from structure 120. Lifting apparatus 110 is then removed from the installation site.

FIG. 4*a* shows a top view of lifting apparatus/structure assemblage 100, comprising lifting apparatus 110 operatively coupled with structure 120. Lifting apparatus 110 has adjustable combined lift point holes 113 and bumpers 114.

FIG. 4*b* shows a front view of Lifting Apparatus/structure apparatus 100 comprising lifting apparatus 110 operatively coupled to structure 120. Swivel Hoist Rings 116 are attached to lower beam 106 (visible in FIG. 1) of lifting apparatus 110. Sling lines 160 are attached to Swivel Hoist Rings 116 and are secured to the base of Structure 120. Sling Lines 160 are then attached to Anchor Shackles 1100. Lifting Apparatus 110 has a Center of Gravity 117, and combined load center of gravity 190 includes the entire Lifting Apparatus/structure apparatus 100.

FIG. 4*c* shows a side view of Lifting Apparatus/structure assemblage 100. Lifting apparatus 110 has top beam 102, a vertical beam 104, and a lower beam 106. Top beam 102 comprises a lifting eye for the weldment only 111 and a lifting eye for the weldment combined with the structure 112. Lower beam 106 has bumpers 114, fork lift pockets 115 and swivel hoist rings 116. Bumpers 114 are used for protection from incidental contact between lower beam 106 and top of structure 120 particularly when de-coupling sling lines 160 from structure 120. Lifting apparatus 110 has a center of gravity 117. Structure 120 is operably connected to lifting apparatus 110 via sling lines 160. Sling lines 160 connect structure 120 to Lifting apparatus 110 using portable load lift points 122 and anchor shackles 1100. Lifting Apparatus/structure assemblage 100 has a combined load center of gravity 190.

Figure 4D:
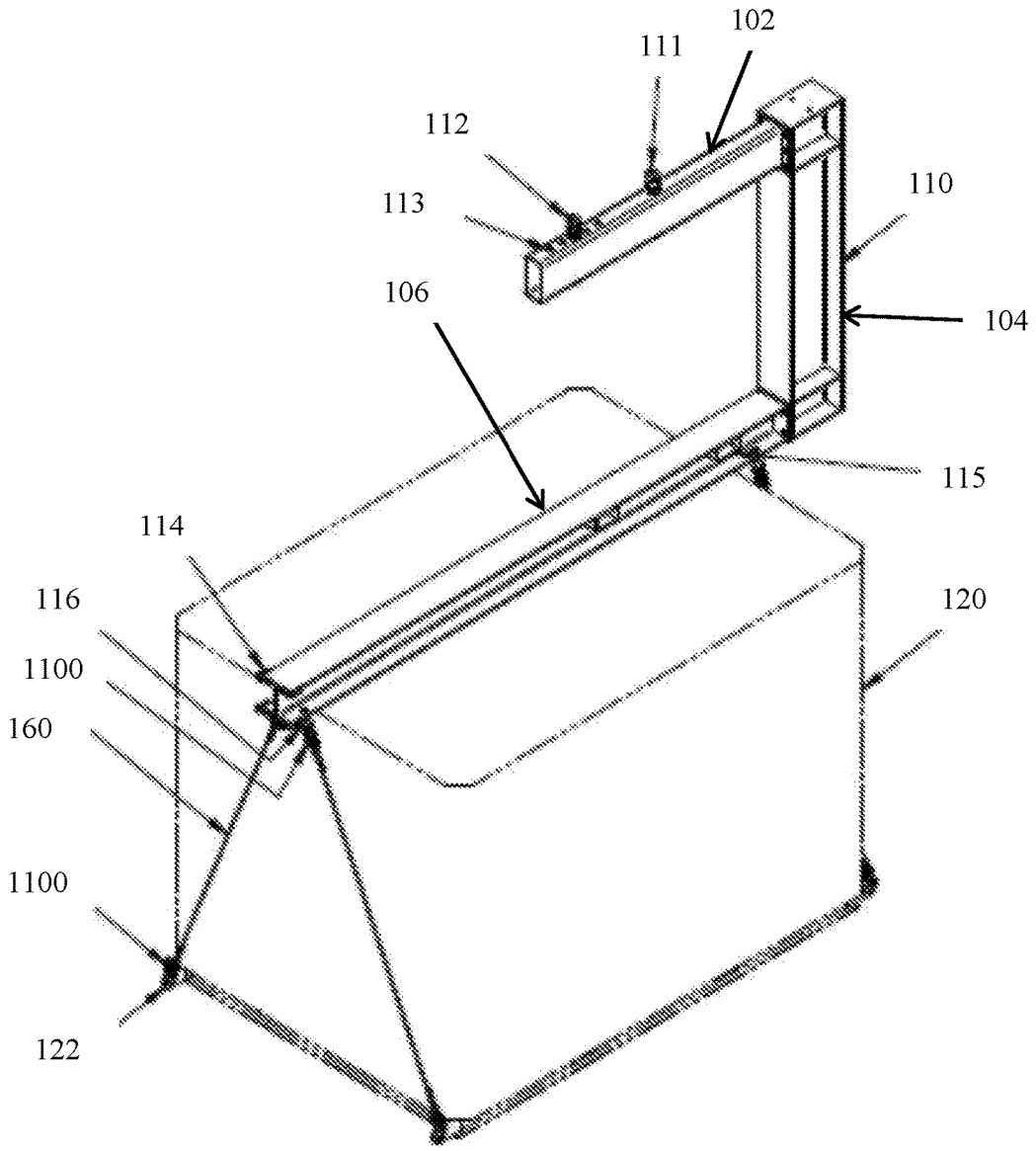
FIG. 4*d* shows an isometric view of a lifting apparatus.

FIG. 4*d* shows an isometric view of lifting apparatus/structure assemblage 100 comprising lifting apparatus 110 and structure 120. Lifting apparatus 110 has a top beam 102, a vertical beam 104, and a lower beam 106. Top beam 102 comprises a lifting eye for the weldment only 111, a lifting eye for the weldment combined with the structure 112, and adjustable combined lift point holes 113. Lower beam 106 has bumpers 114 that are used for protection from incidental contact between lower beam 106 and top of structure 120. Lower beam 106 also has fork lift pockets 115, swivel hoist rings 116, and anchor shackles 1100 that can be used to attach sling lines 160 to structure 120. Structure 120 comprises Load Lift Points 122.

Recovery of structure 120 is performed in reverse order of installation steps described above. The utilization of a novel lifting apparatus design allows for the use of a standard modular building or container to be placed in a vertically inaccessible location using minimum added personnel and resources. Compared with the on-site installation of a structure, the lifting apparatus and method described herein requires very little to no preparation or assembly steps for installation. In one concept design, the apparatus and method only requires three personnel and one hour to install a modular structure. Alternatively, the on-site installation required five personnel eight hours to install a structure with comparable size and features.

Figure 5:
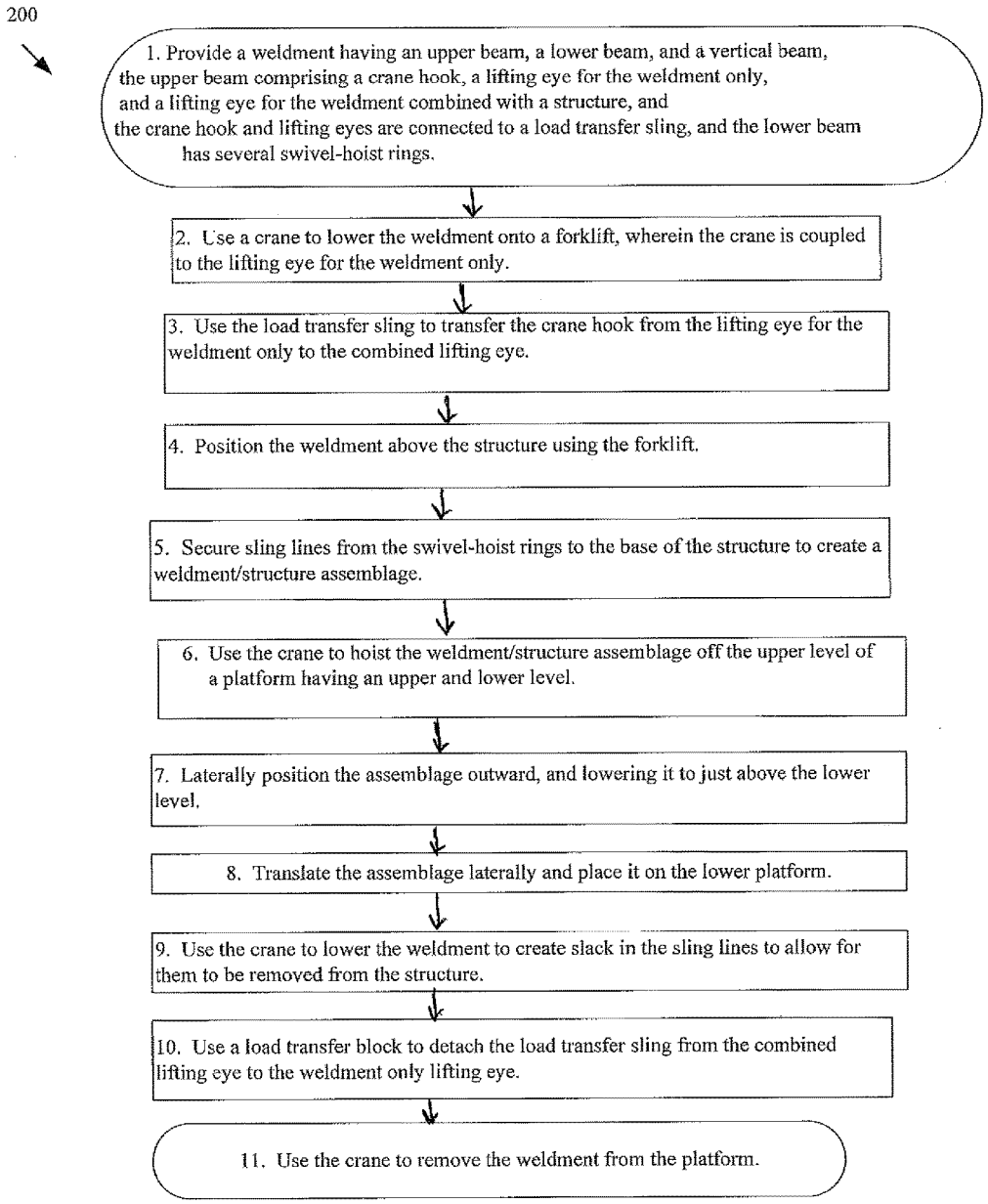
FIG. 5 shows a flow chart for the method of installing a portable structure in a confined vertically inaccessible location.

FIG. 5 shows a flow chart 200 of one embodiment of a method for installation of a portable structure in a confined vertically inaccessible location. Step 1 involves providing a weldment having an upper beam, a lower beam, and a vertical beam, the upper beam comprising a crane hook, a lifting eye for the weldment only, and a lifting eye for the weldment combined with a structure, and the crane hook and lifting eyes are connected to a load transfer sling, and the lower beam has several swivel-hoist rings. Step 2 involves using a crane to lower the weldment onto a forklift, wherein the crane is coupled to the lifting eye for the weldment only. Step 3 is using the load transfer sling to transfer the crane hook from the lifting eye for the weldment only to the combined lifting eye. Step 4 is positioning the weldment above the structure using the forklift. Step 5 is securing sling lines from the swivel-hoist rings to the base of the structure to create a weldment/structure assemblage. Step 6 is using the crane to hoist the weldment/structure assemblage off the upper level of a platform having an upper and lower level. Step 7 is to laterally position the assemblage outward, and lowering it to just above the lower level. Step 8 is to translate the assemblage laterally and place it on the lower platform. Step 9 is to use the crane to lower the weldment to create slack in the sling lines to allow for them to be removed from the structure. Step 10 is to use a load transfer block to detach the load transfer sling from the combined lifting eye to the weldment only lifting eye. Finally, step 11 is to use the crane to remove the weldment from the platform.

An alternative construction pertains to updating the design of the lifting apparatus to have only a single lift point. This could be accomplished by having a "balanced" Lifting Apparatus design which would place a large enough counterweight on the upper beam to lift the Lifting Apparatus and/or assemblage by only a single point. A single lift point can also be accomplished with a mechanized trolley lift point on the upper beam which would translate between the two lift points of the lifting apparatus design. Alternate higher strength and/or higher modulus materials could also provide a smaller envelope profile for the lifting apparatus.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A system comprising a weldment having an upper beam, a vertical beam, and a lower beam, wherein the vertical beam spans the upper beam and the lower beam, wherein the upper beam further comprises a crane hook, a lifting eye for the weldment only, a separate lifting eye for the weldment combined with a structure to be lifted, and a load transfer block, and wherein the lower beam further comprises a plurality of attachment points for enabling attachment of a sling line from a bottom of the weldment to a base of the structure, and a plurality of forklift pockets.

2. The system of claim 1, further comprising a plurality of swivel-hoist rings located at the plurality of attachment points.

3. The system of claim 2, wherein the structure is a building, and the lower beam is a length minimally required to locate the building laterally underneath an upper level of a platform having an upper level and a lower level.

4. The system of claim 3, wherein the lifting eye for the weldment only coincides with the center-of-mass of the weldment.

5. The system of claim 4, wherein a load transfer sling is operably connected to the lifting eyes and the crane hook.

6. The system of claim 5, wherein the weldment is steel.

7. A device comprising a weldment having an upper beam, a vertical beam, and a lower beam, wherein the upper beam further comprises a lifting eye for the weldment only, a separate lifting eye for the weldment combined with a structure to be lifted, and at least one crane hook, and the lower beam further comprises a plurality of swivel-hoist rings for enabling attachment of a sling line from a bottom of the weldment to a base of the structure and a plurality of forklift pockets, and wherein the lower beam is a length minimally required to locate the structure laterally underneath an upper level of a platform having an upper level and a lower level.

8. The device of claim 7 wherein the upper beam further comprises a load transfer block.

9. The device of claim 8 wherein a load transfer sling is operably coupled to the two lifting eyes and at least one crane hook.

10. The device of claim 9 wherein the platform is a pier.

11. The device of claim 10 wherein the weldment is steel.

12. The device of claim 11 wherein the structure is a coastal personnel building.

13. A method for structure installation comprising the steps of:

providing a weldment having an upper beam, a lower beam, and a vertical beam, wherein the upper beam comprises a crane hook, a lifting eye for the weldment only, and a lifting eye for the weldment combined with a structure, and wherein the crane hook and lifting eyes further comprise a load transfer sling, and wherein the lower beam comprises a plurality of swivel-hoist rings;

using a crane to lower the weldment onto a forklift, wherein the crane is coupled to the lifting eye for the weldment only;

using the load transfer sling to transfer the crane hook from the lifting eye for the weldment only to the combined lifting eye;

positioning the weldment above the structure using the forklift;

securing sling lines from the swivel-hoist rings to the base of the structure to create an assemblage including the weldment and the structure;

using the crane to hoist the assemblage off the upper level of a platform, wherein the platform has an upper level and a lower level;

laterally positioning the assemblage outward, and lowering it to just above the lower level;

translating the assemblage laterally and placing it on the lower platform;

using the crane to lower the weldment just enough to create slack in the sling lines to allow for them to be removed from the structure;

using a load transfer block to detach the load transfer sling from the combined lifting eye to the weldment lifting eye;

using the crane to remove the weldment from the platform.

14. The method of claim 13 further comprising the step of recovering the structure by performing the reverse order of the installation steps.

* * * * *